US006164562A

United States Patent [19]

Wu

[11] Patent Number: 6,164,562

[45] Date of Patent: Dec. 26, 2000

[54] ROTARY TYPE SWINGABLE SPRAYER

[76] Inventor: Chung-Cheng Wu, 4F, No. 93, Wen Ming Rd., Kui-Shan, Taoyuan Hsien, Taiwan

[21] Appl. No.: 09/449,909

[22] Filed: Dec. 2, 1999

[51] Int. Cl.[7] ..... B05B 3/04

[52] U.S. Cl. ..... 239/237; 239/240; 239/246; 239/263.3; 137/625.44

[58] Field of Search ..... 239/225.1, 237, 239/240, 246, 263, 263.3, 264, 380–383; 137/625.44

[56] References Cited

U.S. PATENT DOCUMENTS

| | | | |
|---|---|---|---|
| 3,623,667 | 11/1971 | Costa | 239/237 |
| 4,848,662 | 7/1989 | Shevach | 239/241 |
| 4,986,308 | 1/1991 | Champseaux | 137/625.44 |
| 5,337,785 | 8/1994 | Romer | 137/625.44 |
| 5,695,122 | 12/1997 | Messinger | 239/240 |
| 5,720,435 | 2/1998 | Hunter | 239/240 |
| 6,050,502 | 4/2000 | Clark | 239/237 |

*Primary Examiner*—James Hook
*Assistant Examiner*—Lisa Ann Douglas
*Attorney, Agent, or Firm*—Jacobson, Price, Holman & Stern, PLLC

[57] ABSTRACT

A rotary type swingable sprayer comprising a fixing tube head, a rotatable tube head, and a nozzle tube. The rotatable tube head is installed atop the fixing tube head, and the nozzle tube is installed atop the rotatable tube head. The lower end of the fixing tube head is connected with a water tube for guiding water. When water flows through the rotatable tube head, the rotatable tube head will swing nearly a full cycle repeatedly so as to drive the nozzle tube above to swing repeatedly. Thus, water is jetted out from the distal end of the nozzle tube. Therefore, water is sprayed out nearly through a full cycle in the whole area.

1 Claim, 6 Drawing Sheets

ROTARY TYPE SWINGABLE SPRAYER

FIELD OF THE INVENTION

The present invention relates to a rotary type swingable sprayer comprising a fixing tube head, a rotatable tube head and a nozzle tube. The water flows through the rotatable tube head to cause the rotatable tube head to rotate nearly through a completely circle, therefore, water can be sprayed almost through a whole circle.

BACKGROUND OF THE INVENTION

Generally, the meadows in the gardens or yards must be sprayed with water and cut for retaining the grass in order.

In the prior art, sprayers are installed with a cambered water guide piece which is rotatable atop the water nozzle. When water is jetted from the nozzle, it firstly flow through the water guide piece. While when water flows through the water guide piece, the water guide piece will rotate. Thus, the sprayed water may spray through a full cycle to form a round spraying area. Thus, the meadow can be sprayed completely.

The spraying speed of a prior art sprayer is determined by the flow speed of water. The faster the speed, the more rapid the rotation of the water guide piece. Thus, the water is sprayed with a higher speed. Therefore, the water sprayed to the meadow is not uniform. As a result, a longer time for spraying is required. Inversely, the slower the speed, the slower the spraying, and thus too much water is sprayed to the meadow. Moreover, the spraying area is reduced. Therefore, the prior art sprayer is not an ideal design.

Moreover, the prior art sprayer has a shape suitable for the requirement of mechanics so not to present a beautiful outlook. Therefore, it is not suitable to be used in a beautiful garden.

SUMMARY OF THE INVENTION

Accordingly, the primary object of the present invention is to provide a rotary type swingable sprayer comprising a fixing tube head, a rotatable tube head, and a nozzle tube. The rotatable tube head is installed atop the fixing tube head, and the nozzle tube is installed atop the rotatable tube head. The lower end of the fixing tube head is connected with a water tube for guiding water. When water flows through the rotatable tube head, the rotatable tube head will swing nearly in the full traveling range repeatedly so as to drive the nozzle tube above to swing repeatedly. Thus, water is jetted out from the distal end of the nozzle tube. Therefore, water is sprayed out nearly in the whole area.

The various objects and advantages of the present invention will be more readily understood from the following detailed description when read in conjunction with the appended drawing.

DETAILED DESCRIPTION OF THE PREFERRED EMBODIMENTS

Figure 1:
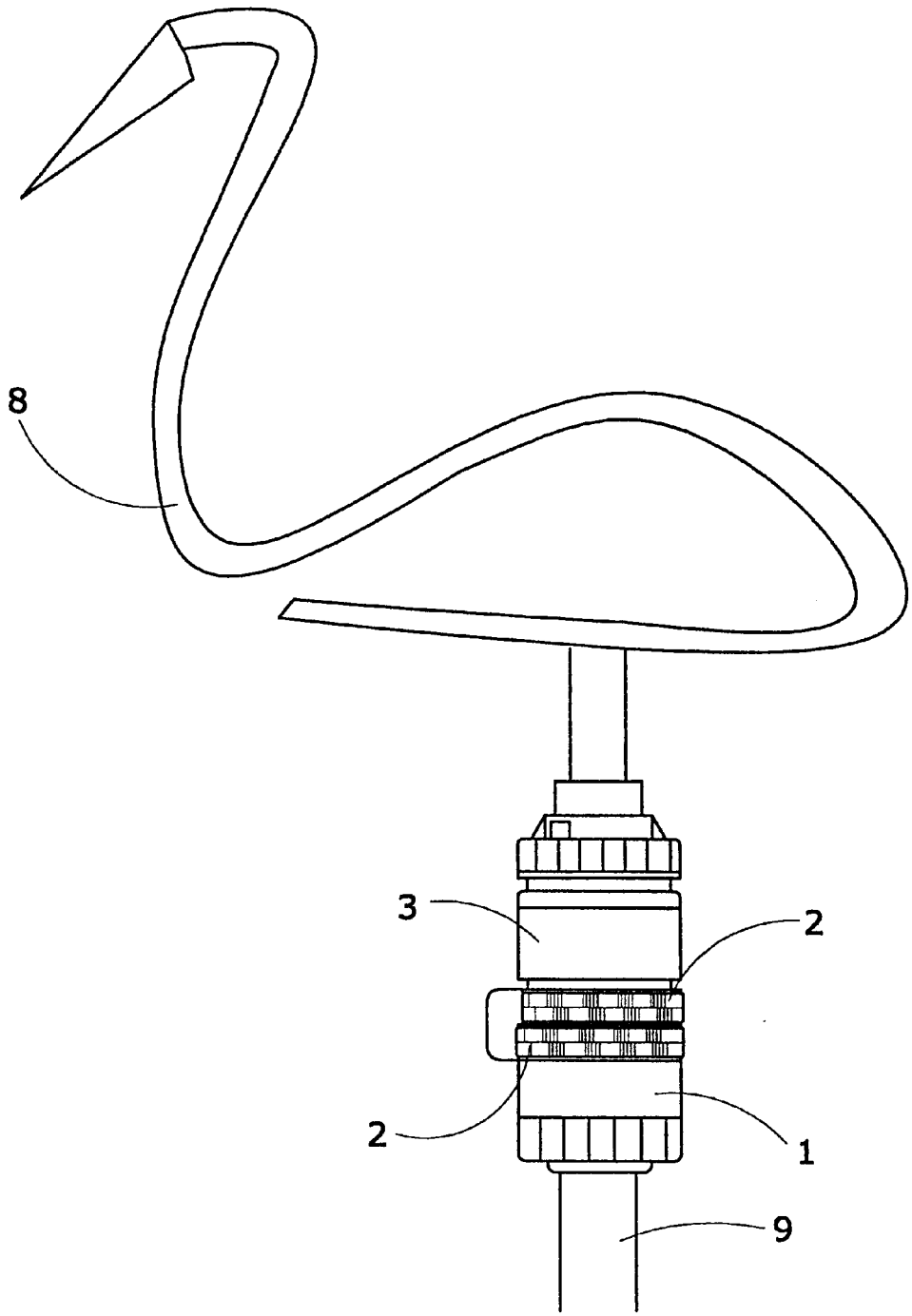
FIG. 1 is a front view of the present invention.
Figure 2:
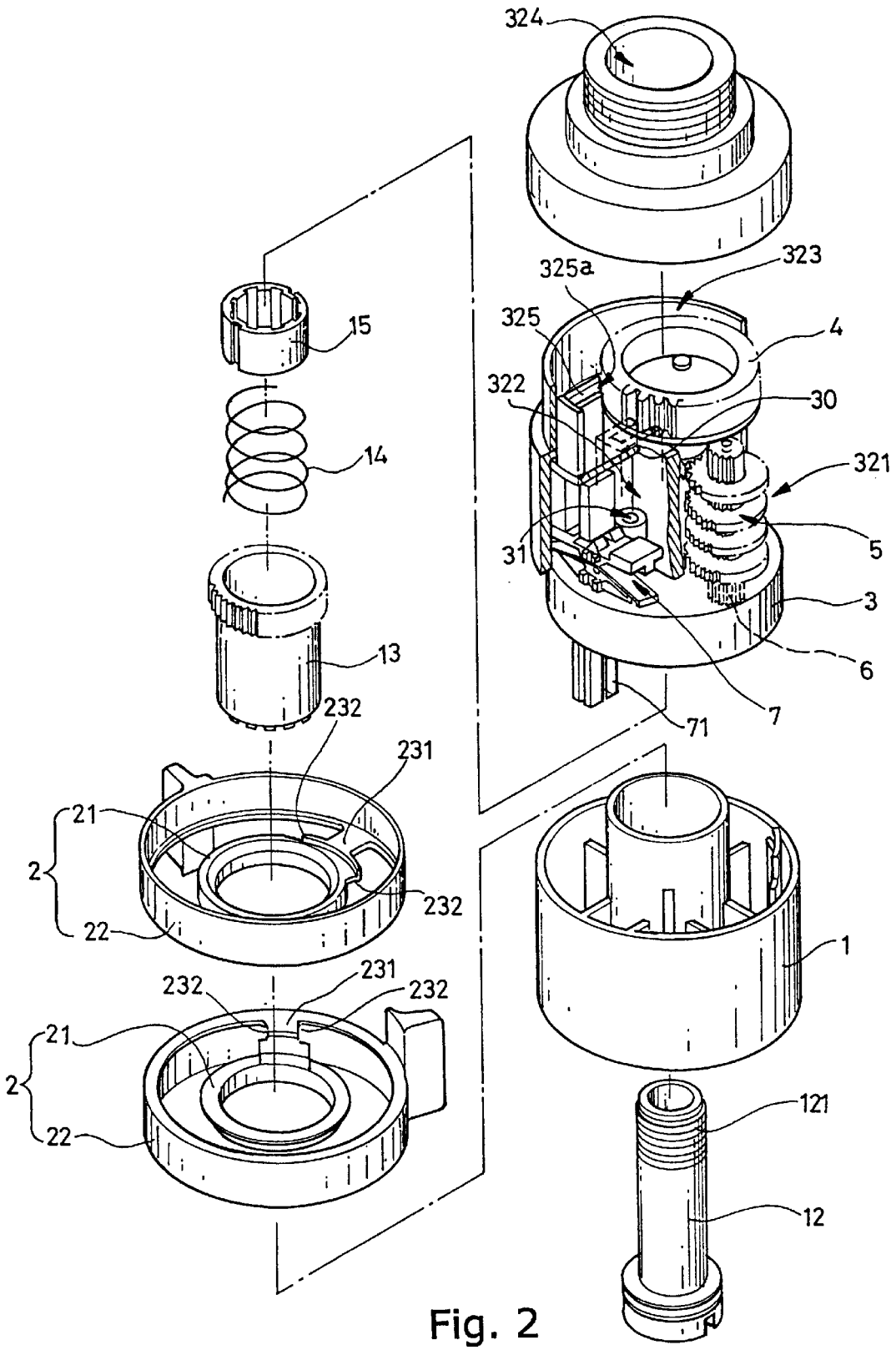
FIG. 2 is an exploded perspective view of the present invention.
Figure 3:
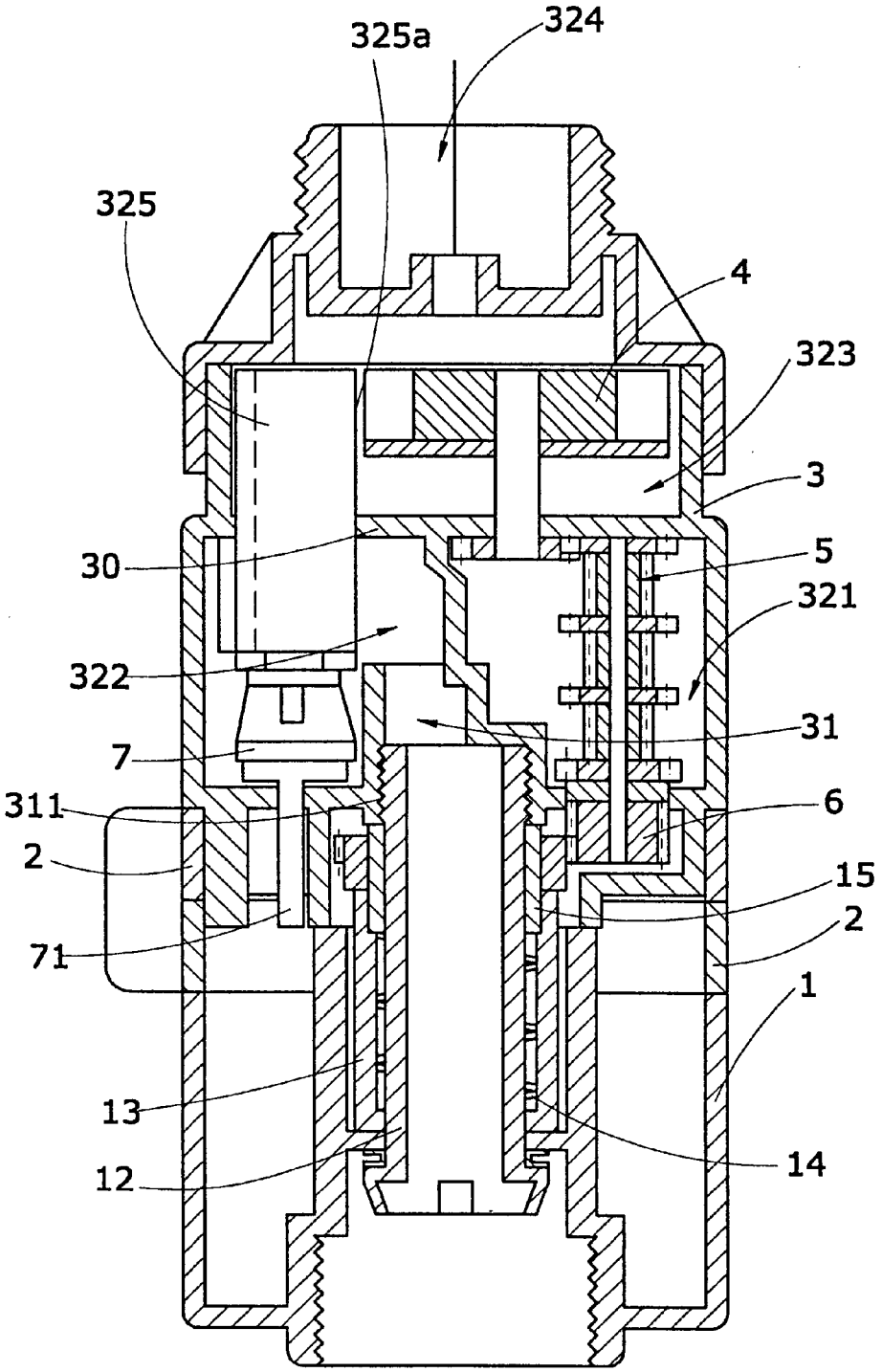
FIG. 3 is an assembled cross sectional view of the present invention.
Figure 4:
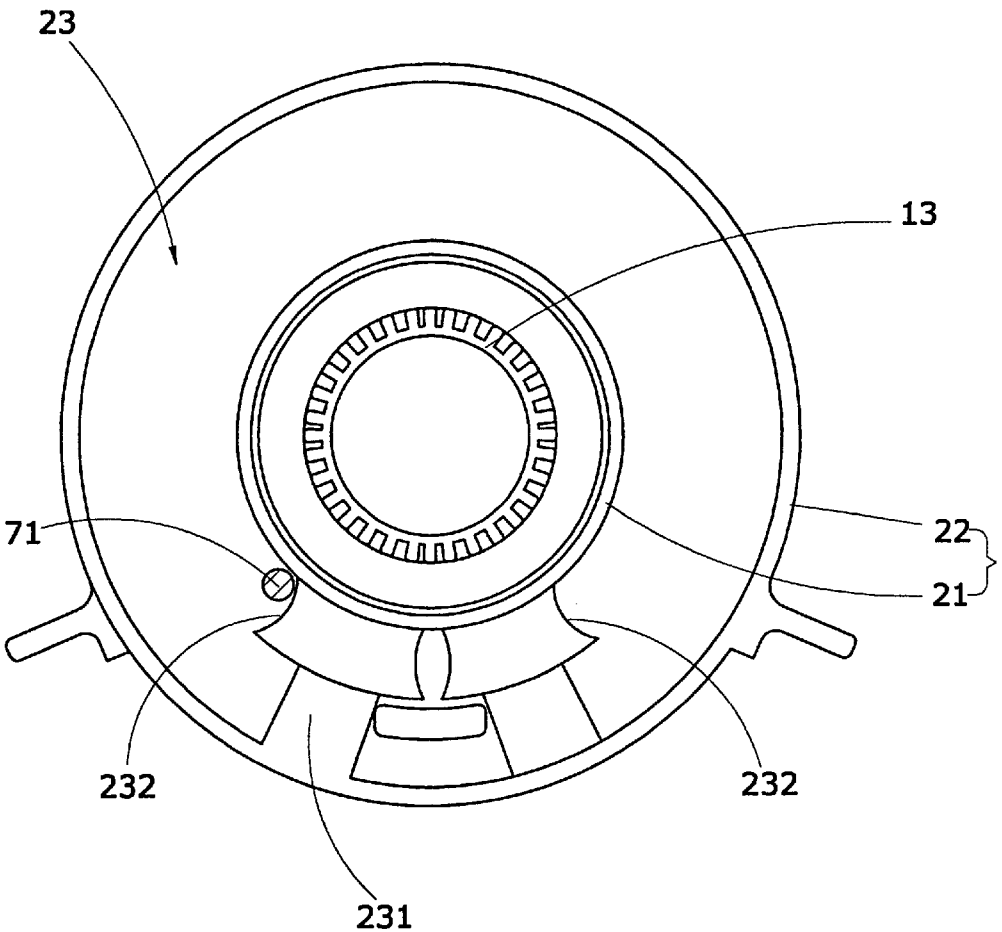
FIG. 4 is an upper view of the rotary ring according to the present invention.

With reference to FIGS. 1, 2, and 3, the present invention is formed by following components, the positions and constructions of these components will be described in the following:

A fixing tube head 1 has a center tube 11. A hollow tube 12 with an thread 121 on one end is installed in the center tube 11. A gear tube 13 encloses the hollow tube 12 and then a spring 14 and a sleeve 15 encloses the hollow tube 12. The center tube 11 of the fixing tube head 1 is covered by two rotatable rotary rings 2 formed by an inner ring 21 and an outer ring 22, as shown in FIG. 4. A ring groove 23 is formed between the inner ring 21 and the outer ring 22. The ring groove 23 is installed with a connecting arm 231 two sides of which is extended outwards with a cambered positioning piece 232.

Figure 5:
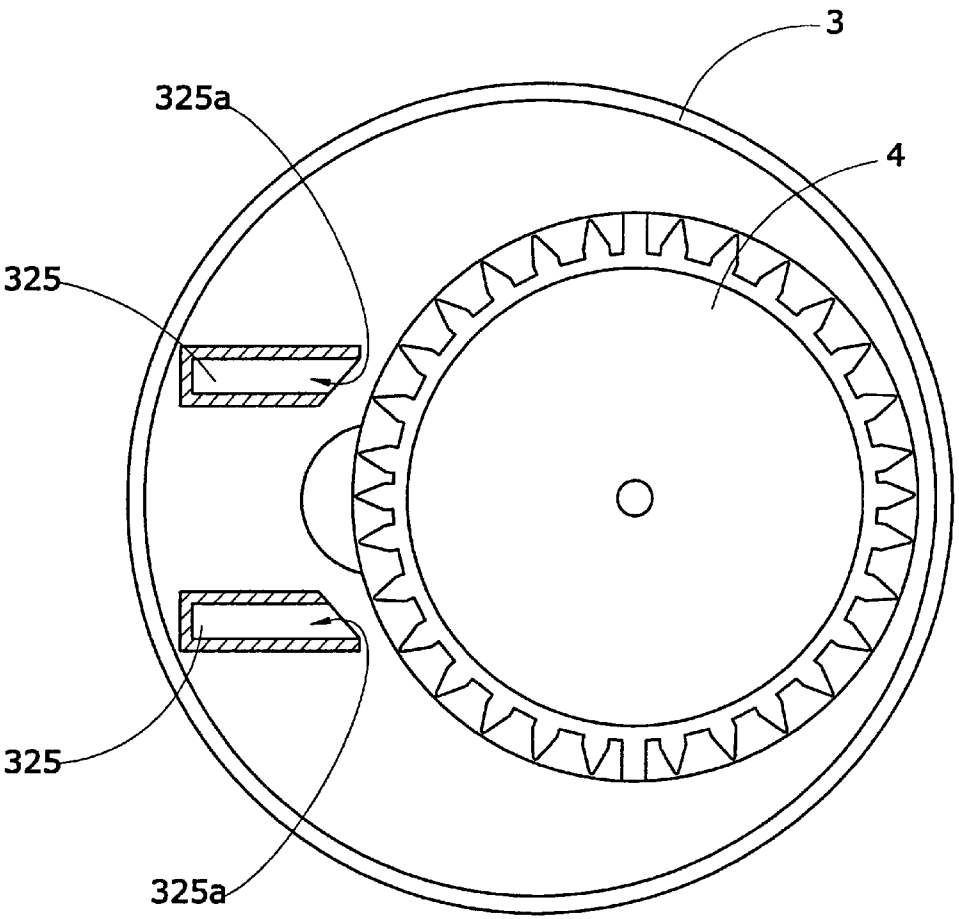
FIG. 5 is an upper view showing the water guide tube within the rotatable tube head and the blade rotary wheel according to the present invention.
Figure 6:
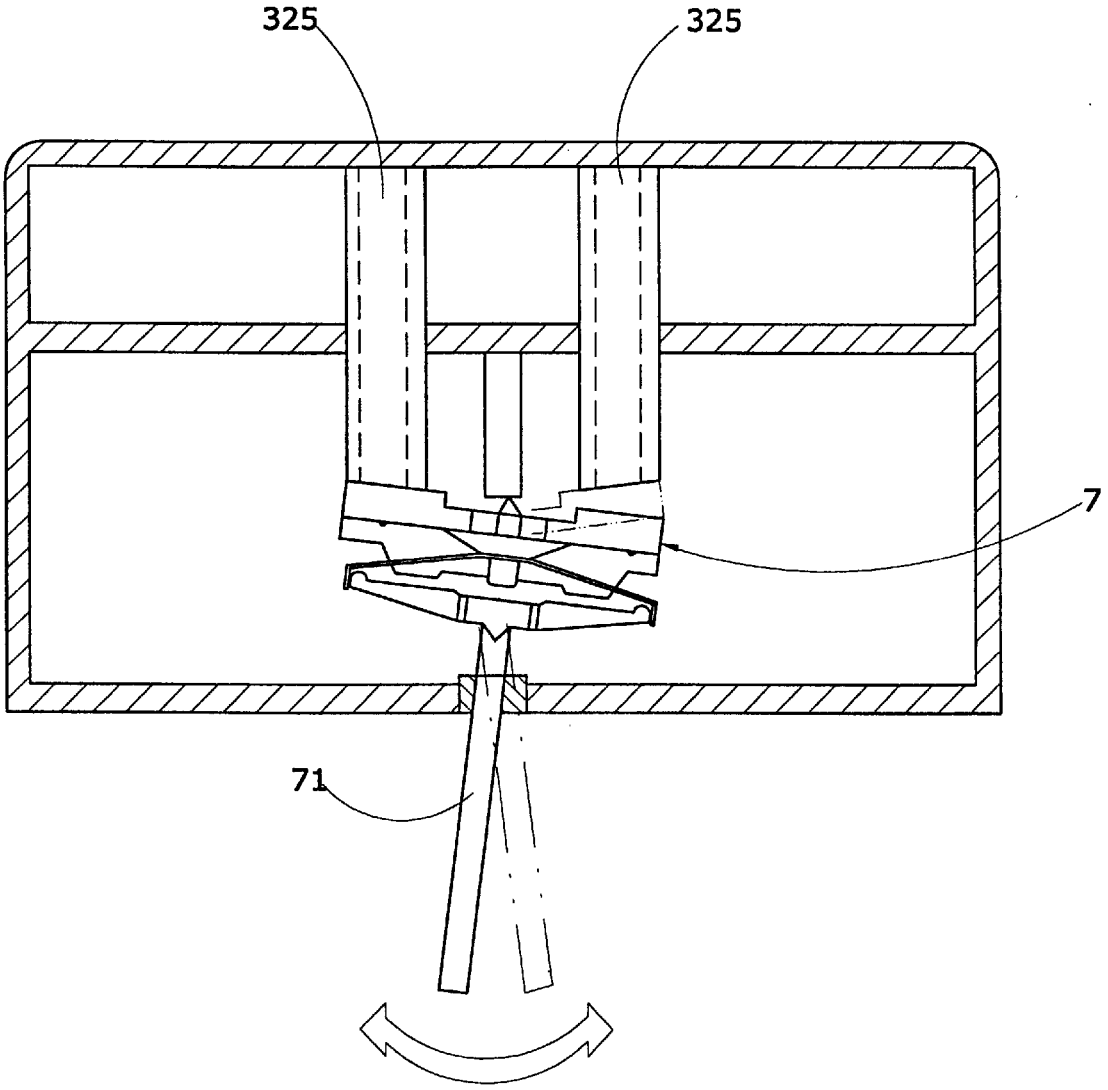
FIG. 6 is a partial view showing the water guide tube of the rotatable tube head and the swingable switching valve according to the present invention.

The rotatable tube head 3 is installed atop the fixing tube head 1. The lower end of the rotatable tube head 3 has a water inlet 31 with a threaded hole 311 so that the thread 121 at the top end of the hollow tube 12 passed through by the fixing tube head 1 can be threaded installed on the thread hole 311 at the bottom of the rotatable tube head 3. The rotatable tube head 3 is spaced into two lower spaces 321 and 322 and an upper space 323. One of the lower space 322 is connected to the water inlet. The upper portion of the upper space 323 has a water outlet 324. The upper space 323 is installed with a blade rotary wheel 4. One of the lower space 321 is installed with a gear set 5. An active gear 6 is installed below the rotatable tube head 3. The blade rotary wheel 4 drives the active gear 6 through the gear set 5, so that the active gear 6 is engaged with gear tube 13 within the fixing tube head 1. Two water guide tube 325 are installed on the spacer 30 between the lower space 322 and the upper space 323 connected to the water inlet 31, so that a nozzle 325*a* is formed at the top end of the water guide tube 325. As shown in FIG. 5, the nozzle 325*a* is faced to the blade rotary wheel 4 along the tangent direction. A swingable switching valve 7 is installed below the two water guide tube 325, as shown in FIG. 6., and has a swingable rod 71 installed at the lower end thereof. The lower end of the swingable rod 71 may place against the ring groove 23 of the rotary ring 2, as shown in FIG. 4.

The nozzle 8 is installed on the water outlet 324 of the rotatable tube head 3 and is a curved tube with any shape.

According to aforesaid structure, the lower side of the fixing tube head 1 can be connected to a water tube 9. When water flows out from the lower end of the fixing tube head 1, it will flow into the rotatable tube head 3 through the hollow tube 12, then flowing to the lower space 322 from the water inlet 31 of the rotatable tube head 3, then flowing to the upper space 323 through one water guide tube 325, then jetting out to the blade rotary wheel 4 from the nozzle 325*a* at the top end of the water guide tube 325 so that the blade rotary wheel 4 drives the active gear 6 to rotate through the gear set 5. Moreover, since the active gear 6 is engaged with the gear tube 13 fixed within the fixing tube head 1, as the active gear 6 rotates, the rotatable tube head 3 rotates.

When the rotatable tube head 3 rotates, since the swingable rod 71 at the lower portion of the swingable switching valve 7 within the lower space 322 is inserted into the rotary ring 2, and two sides of the connecting arm 231 of the rotary ring 2 are extended outwards with cambered positioning piece 232. As the distal end of the swingable rod 71 touches one of the positioning piece 232, the swingable switching valve 7 will shift to swing so as to seal one water guide tube 325 to cause that another water guide tube 235 is opened. Then, water flows into this tube, so that the blade rotary wheel 4 rotates reversely. When the rotatable tube head 3 rotates to the end, it will change the rotating direction as that described above. Therefore, the rotatable tube head swings repeatedly.

The jetted water from the nozzle 325*a* of the water guide tube 325 will drain out from the water outlet 324 at the upper portion of the rotatable tube head 3, and then the water is sprayed from a nozzle tube 8. Since the nozzle tube 8 is installed on the rotatable tube head 3, the nozzle 8 can swing in a full circle with the rotatable tube head 3 to spray through a full area.

Furthermore, since the rotatable tube head 3 drives the blade rotary wheel 4 to rotate by the water flow, the gear set 5 will be driven to cause that the active gear 6 will rotate around the gear set 13. Therefore, the rotatable tube head 3 steadily rotates so that the spraying area is steady without dramatic change and the uniform spray water distribution is formed.

Besides, since the nozzle tube 8 can be a bending tube with any shape desired by the consumer. Therefore, it is a high creation in artist. This will meet favors of consumers.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A rotary type swingable sprayer comprising:

a fixing tube head having a center tube; hollow tube with an thread on one end passing through the center tube, a gear tube enclosing the hollow tube and a spring and a sleeve enclosing the hollow tube; the center tube of the fixing tube head being covered by two rotatable rotary rings formed by an inner ring and an outer ring; a ring groove being formed between the inner ring and the outer ring; the ring groove including with a connecting arm having two sides extended outwards with a cambered positioning piece;

the rotatable tube head being installed atop the fixing tube head; a lower end of the rotatable tube head having a water inlet with a threaded hole so that a thread at the top end of the hollow tube passed through by the fixing tube head can be threadedly installed on the thread hole at the bottom of the rotatable tube head; the rotatable tube head being spaced as two lower spaces and an upper space; one of the lower spaces being connected to the water inlet; the upper portion of the upper space having a water outlet; the upper space being installed with a blade rotary wheel; one of the lower spaces being installed with a gear set; an active gear being installed below the rotatable tubes head; the blade rotary wheel driving the active gear through the gear set, so that the active gear is engaged with the gear tubes within the fixing tube head; two water guide tube being installed on the spacer between the lower space and the upper space connected to the water inlet, so that a nozzle is formed at the top end of the water guide tube; the nozzle being faced to the blade rotary wheel along a tangent direction; a swingable switching valve being installed below the two water guide tubes; a swingable rod installed at the lower end thereof; a lower end of the swingable rod can place against the ring groove of the rotary ring;

a nozzle tube being installed on the water outlet of the rotatable tube head and is a curved tube with any shape.

* * * * *